US005452813A

United States Patent [19]

Grow et al.

[11] Patent Number: 5,452,813

[45] Date of Patent: Sep. 26, 1995

[54] SHELF SUPPORT STRIP

[75] Inventors: Joel L. Grow, Hollister; Jack Hardee, Jr., Salinas, both of Calif.

[73] Assignee: Monterey Shelf, Inc., Salinas, Calif.

[21] Appl. No.: 185,705

[22] Filed: Jan. 24, 1994

[51] Int. Cl.[6] ..... A47B 57/08

[52] U.S. Cl. ..... 211/187; 248/235

[58] Field of Search ..... 211/90, 134, 187, 211/207, 208; 248/235, 243, 916; 52/36.4, 36.5, 36.1, 236.6, 236.9, 236.7, 702; 24/487, 543

[56] References Cited

U.S. PATENT DOCUMENTS

| | | | |
|---|---|---|---|
| 2,783,961 | 3/1957 | Weber | 348/243 |
| 2,967,625 | 1/1961 | Hoogenstyn | 108/109 X |
| 3,471,112 | 10/1969 | MacDonald et al. | 248/239 |
| 3,481,485 | 12/1969 | Hess | 211/134 |
| 3,910,204 | 10/1975 | Jesse | 108/55 |
| 4,037,813 | 7/1977 | Loui et al. | 248/250 |
| 4,053,132 | 10/1977 | Del Pozzo | 248/235 |
| 4,289,289 | 9/1981 | Overman | 248/235 |
| 4,732,358 | 3/1988 | Hughes et al. | 248/243 |
| 5,069,350 | 12/1991 | Wolff et al. | 211/186 |

FOREIGN PATENT DOCUMENTS

| | | | |
|---|---|---|---|
| 2232343 | 12/1990 | United Kingdom | 211/187 |

*Primary Examiner*—Leslie A. Braun
*Assistant Examiner*—Catherine S. Collins
*Attorney, Agent, or Firm*—Flehr, Hohbach, Test, Albritton & Herbert

[57] ABSTRACT

A shelf support strip is disclosed for supporting the ends of a plurality of shelves in vertically spaced-apart relationship. The shelf support strip comprises an elongate base having an integrally molded web portion and parallel side flanges which define a generally U-shaped channel. A plurality of box-like shelf support members are positioned in vertically spaced-apart relationship along the base, and each shelf support member is comprised of upper and lower end walls together with a front wall. The lower wall of each shelf support member is connected with one of the ribs to provide a pivot for moving the support member between a shelf-supporting position and a retracted position. A short vertical web is provided at the inner end of the gap which is formed between the lower end wall and reinforcing rib of each shelf support member. The vertical rib yieldably resists pivotal movement of the shelf support member from loads imposed by the shelf.

8 Claims, 2 Drawing Sheets

SHELF SUPPORT STRIP

BACKGROUND OF THE INVENTION

1. Field of the Invention

This invention relates in general to devices for supporting shelves in parallel, vertically spaced relationship. More particularly, the invention relates to an improvement over the shelf support device described in U.S. Pat. No. 4,289,289 to Overman issued Sep. 15, 1981 and owned by Monterey Shelf, Inc., the assignee of the present invention.

2. Description of the Prior Art

In the prior art, different types of shelf support devices are provided including brackets, hangers, strips and other arrangements for supporting a shelf between two upright parallel end panels. Among this prior art are the devices shown in U.S. Pat. Nos. 4,053,132; 4,037,813; 3,910,204; 3,481,485; 3,471,112; and 2,783,961.

U.S. Pat. Nos. 4,067,530 and 4,289,289 to Overman provide shelf support strips that are injection molded in a single operation from synthetic resinous material. This enables repeatability of design and adherence to manufacturing tolerances, and permits uniformity among the manufactured strips.

Many conventional shelf support devices utilize a number of different parts. In one such prior design, a pair of elongate strips are mounted upright to support upstanding end panels in a shelf assembly. These strips are apertured for mounting a shelf support member. Such a separate support member is not integral with the strip with which it is supported, and constitutes a source of weakness in the shelf support system. It would be desirable to provide a shelf support strip in which all of the elements are integral, except for the screws or staples which attach the strip to a support structure or panel.

Many conventional shelf support brackets and strips which utilize moveable or adjustable shelf hanger units incorporate an apertured strip so that the hanger unit can be adjusted in height in accordance with the height of objects, such as books, that may be stacked on a shelf. It would be desirable to provide a shelf support arrangement which permits the shelves to be easily mounted with the desired vertical spacing without the requirement of adjusting any components of the unit itself.

The shelf support member disclosed in U.S. Pat. No. 4,289,289 provides a "live" hinge which permits passage of the shelf into proper position, which was found to be an advantage over the type of prior shelf support member shown, for example, in U.S. Pat. No. 4,067,530. However, it has been found that such a "live" hinge lacks sufficient strength to be reliable, and the support elements have a tendency to break off in the area of the "live" hinge.

The shelf support member of U.S. Pat. No. 4,289,289 also includes two parallel side members that transmit load forces from the shelf to the supporting panel or wall. It has been found that upon application of excessive loads, these side members tend to separate, which can lead to collapse of the shelf support member. It would be desirable to provide a shelf support strip which obviates this problem.

The need has been recognized for a shelf support strip which obviates the foregoing and other limitations and disadvantages of the prior art shelf support devices. Despite the various shelf support devices in the prior art, there has not yet been provided a suitable and attractive solution to these problems.

OBJECTS AND SUMMARY OF THE INVENTION

It is an objection of the invention to provide a shelf support strip which is an improvement over the device disclosed in U.S. Pat. No. 4,289,289.

Another object is to provide a shelf support strip providing an enhancement of the conventional "living" hinge arrangement for connecting the individual shelf support members to the strip in a manner which obviates the problem of breakage of the members.

Another object is to provide a shelf support strip of the type described which is adapted for fabrication in a single operation from an injection molded synthetic resinous material.

Another object of the invention is to provide a shelf support strip of the type described in which all of its essential components, excepts screws and staples, are integrally formed in a single unit.

Another object is to provide a shelf support strip of the type described which includes a U-shaped pivot for connecting individual shelf support members to the support structure.

Another object is to provide a shelf support strip of the type described in which the side members of shelf support members are integrally joined by means of a reinforcing rib to prevent their collapse upon application of load forces from the shelves.

Another object is to provide a shelf support strip of the type described which is mounted on a support structure through a flexible lower end wall, one end of which is integrally connected at the innermost side of the support structure remote from the shelf support member.

The invention in summary provides a shelf support member comprising an elongate base integrally molded with a plurality of box-like shelf support members which are longitudinally spaced along the base member. Each base is formed with a U-shaped channel which is integrally connected at its lower end with the shelf support member to form a U-shaped pivot or bight portion. The U-shaped pivot enables pivotal movement of the shelf support member between an extended shelf-supporting position and a retracted position. For mounting of the shelves, the shelf is inserted and moved upwardly for camming the shelf support member toward its retracted position until the shelf end clears the upper end of the member. Loads on the shelf are transferred downwardly against the shelf support members which pivot toward the shelf-supporting position. Under excessive loads, the lower wall of the shelf support member moves downwardly to engage with a portion of the shelf support base.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
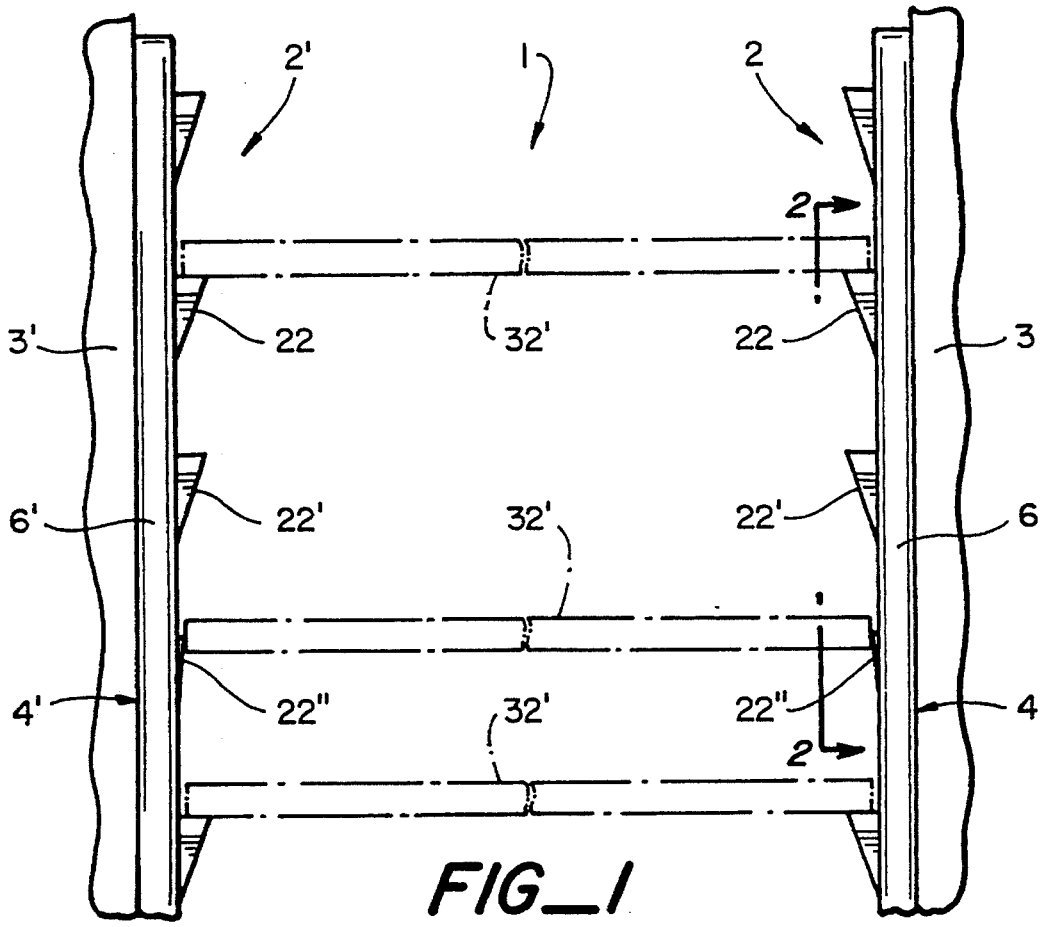
FIG. 1 is front elevation view of a shelf support assembly incorporating one embodiment of the invention.
Figure 4:
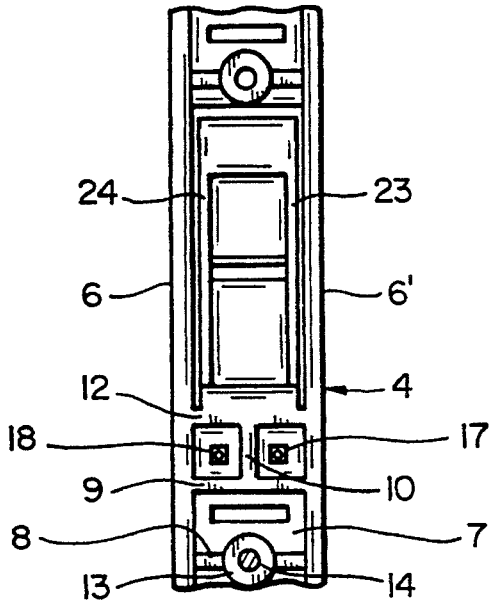
FIG. 4 is a fragmentary rear elevation view taken along the line 4—4 of FIG. 3.

The drawings illustrate generally at 1 a shelf support assembly for supporting the ends of a plurality of shelves in vertically spaced-apart relationship. Shelf support assembly 1 is comprised of a pair of shelf support strips 2,2' which are adapted for vertical mounting in laterally spaced-apart relationship between a suitable support structure 3,3' which can be, for example, the end walls or panels of a bookcase.

The shelf support strips 2,2' are each comprised of an elongate base 4,4' molded of a suitable synthetic resinous material. Each base is comprised of a webbed portion 5 which is molded integrally with a pair of elongate, parallel side flanges 6,6'. The webbed portion and side flanges collectively define a generally U-shaped channel having front and rear sides. The rear side extends to a predetermined depth behind the front side.

The inside surface 7 of the webbed portion 5 is formed integrally with a plurality of reinforcing ribs 8, 9 and 12 at spaced-apart intervals. The ribs extend between side flanges 6 and 6' and are spaced to form a series of longitudinally spaced clusters of the reinforcing ribs. The first rib 8 extends transversely between the side flanges and merges with the outer periphery of a collar 13 which is integral with the inside surface of webbed portion 5.

Figure 2:
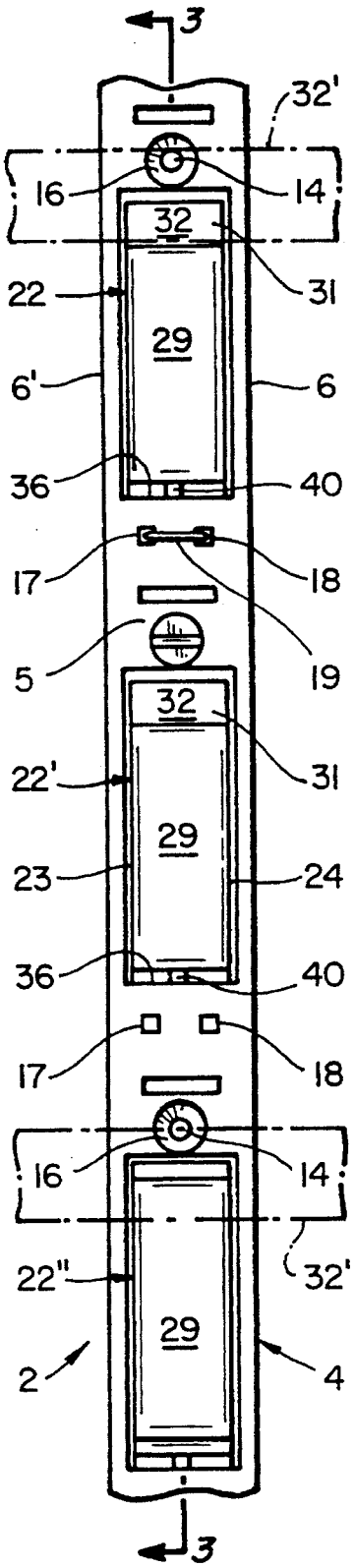
FIG. 2 is a fragmentary front elevation view to an enlarged scale of one of the shelf support strips which is a part of the assembly shown in FIG. 1.
Figure 3:
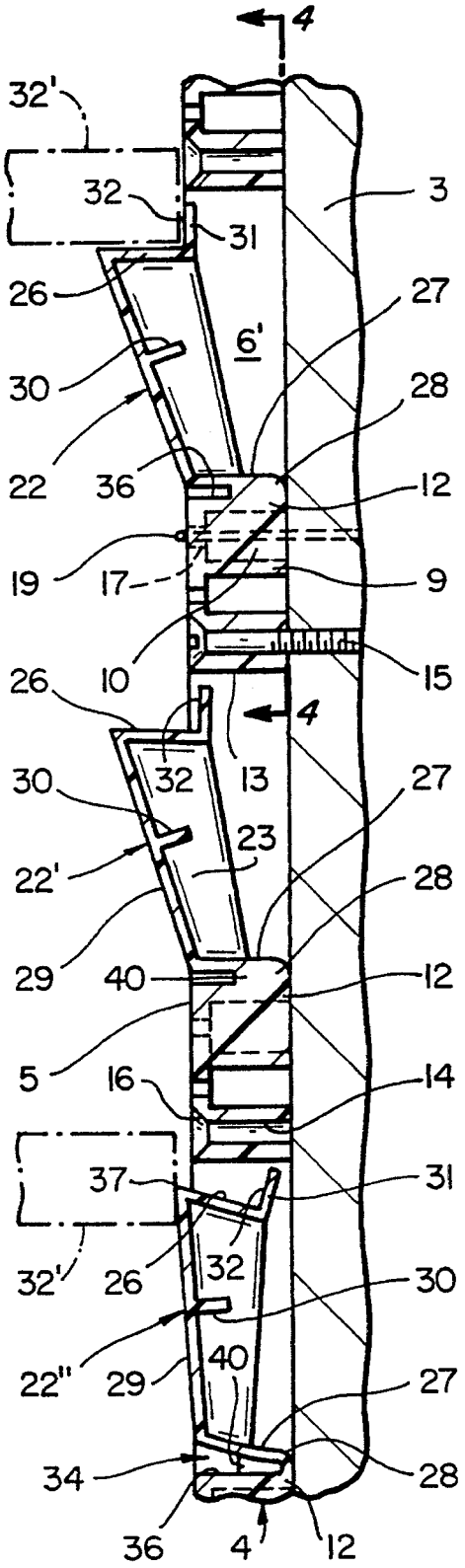
FIG. 3 is a vertical cross sectional view taken along the line 3—3 of FIG. 2.

The collar 13 provides a bore 14 through which a mounting screw 15 may be inserted, as best shown in FIGS. 2 and 3. The outer or facing surface 16 of the webbed portion which surrounds the bore is chamfered to receive the flat head of the mounting screw. The next adjacent or second reinforcing rib 9 is also disposed between side flanges 6 and 6' and is itself reinforced by a longitudinally extending gusset 10 which is integrally connected at one side with reinforcing rib 9 and at the opposite side with the third reinforcing rib 12. The gusset cooperates with flanges 6 and 6' to define a pair of apertures 17 and 18 which are formed in the facing web of the strip on opposite sides of the gusset. The apertures 17 and 18 receive the tines of an appropriate mounting staple 19 (FIG. 3) which is driven through the apertures and into the underlying support structure 3. Gusset 10 extends between the second and third reinforcing ribs 9 and 12, respectively. The gusset also functions to strengthen and rigidify the webbed portion 5, which must be capable of withstanding the pressure from a stapling gun.

A plurality of shelf support members 22, 22' and 22" are positioned in vertically spaced-apart relationship along the vertically positioned base member 4. Each shelf support member is of a box-like configuration and is formed of two laterally spaced-apart, parallel side walls 23 and 24, upper end wall 26, lower end wall 27 and a front wall having a front surface 29. The inner edge of lower end wall 27 is integrally connected by means of a U-shaped pivot or bight portion 28 to the upper surface of rib 12 at a pivot position which is substantially adjacent the rear side of the U-shaped channel. Bight portion 28 pivotally connects the lower wall of the shelf support member to the rib 12 for movement of the shelf support member in a vertical plane between a shelf-supporting position and a retracted position. The shelf support member 22 which is uppermost in FIG. 3 is shown in its shelf-supporting position, while the shelf support member 22" which is lowermost in the figure is shown in its retracted position. By this arrangement, lower end wall 27 extends substantially the full depth of the channel so that bight portion 28 abuts the support structure 3 to which strip 4 is attached. This abutment enables the shelf support members to support a greater weight.

Front surface 29 of the box-like shelf support member is generally rectangular and is integrally formed with the parallel side walls 23 and 24, while also intersecting the end walls 26 and 27 at an angle. The upper end of front wall surface 29 intersects top end wall 26 at an acute angle. The forward edge of lower end wall 27 intersects front wall surface 29 at an obtuse angle. The shelf support member is open on the side remote from the front wall surface so that the support member is essentially hollowed out, primarily to reduce the weight of the strip. As desired, the shelf support member could be solid rather than hollow. A transversely extending reinforcing rib 30 is formed on the inside of front wall surface 29 and extends between side walls 23 and 24 to prevent splaying of the side walls when the shelf support member is under load forces from a shelf.

A flange 31 projects upwardly from top end wall 26 of the support member. The flange provides a buttress surface 32 perpendicular to the shelf support wall so as to abut with one end surface of a shelf 32'. In FIG. 3, a slight space has been indicated between these opposing surfaces for purpose of clarity.

The shelf 32' can be installed onto a horizontally opposed pair of shelf support members 22 by first inserting the shelf in horizontal alignment so that its opposite ends are immediately below the respective shelf support members. The shelf is then lifted upwardly so that the shelf ends push against the front wall surface 29 of the shelf support member in a camming action. This camming action pivots the shelf support member inwardly toward its retracted position, as illustrated at the bottom of FIG. 3 where the right-hand end of the shelf is shown as it cams shelf support member 22" inwardly into its retracted position. The shelf is then moved upwardly until its lower edge clears the front corner of the shelf support member. The elastic memory in the material of bight portion 28 then causes the shelf support member to spring back toward its shelf-supporting position.

At the lower end of the shelf support member where its lower edge portion is integrally attached by the bight portion 28 to the reinforcing rib 12, the angular disposition of the lower end wall 27 provides a widened gap 34 between the lower end wall and upper surface 36 of the reinforcing rib. At the same time, at the opposite or upper end of the shelf support member the depth of the shelf support member is somewhat greater than the depth of the channel formed by the strip. When the shelf support member is fully retracted to the position shown at the bottom of FIG. 3, a corner portion 37 of the shelf support member projects from the face of this strip so that when the shelf is raised past this corner portion and then lowered, the bottom surface of the shelf engages this corner portion.

It will be seen that a major portion of the load from the shelf is carried by means of compression of the shelf support member as the load forces are transferred through lower end wall 27 and through its integral connection with reinforcing rib 12. In addition, since downward pressure by the shelf establishes a force moment which is counterclockwise, as viewed in FIG. 3, then the upwardly extending buttress surface 32 which abuts the end surface of the shelf counteracts this force moment. This assists the shelf support member to withstand the loads which are imposed from the shelf.

A vertical web 40 is integrally formed at the inner end of the slot which is between the support member's lower end wall 27 and the upper surface 36 of reinforcing rib 12. The web 40 extends a predetermined distance forward of bight portion 28, and optimally this distance is substantially 50% of the depth of the slot between lower wall 27 and upper surface 36. This web provides yieldable resistance against downward pivotal movement of the shelf support member. Because of the resilient elasticity of the web and its surrounding material, increasing loads from the shelf will pivot the shelf support member proportionally. When extreme loads are encountered the forward edge of lower end wall 27 abuts against and is supported by the forward upper edge of reinforcing rib 12. At this point the shelf support member is restrained against further pivotal movement. This action of vertical web 40 ensures that the shelf support member has sufficient flexibility so that it will "give," i.e. yield, and not break as heavy loads are encountered.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A shelf support strip for supporting the ends of a plurality of shelves in vertically spaced-apart relationship, the shelf support strip comprising the combination of an elongate base molded of a synthetic resinous material, said base including a web portion integral with a pair of elongate parallel side flanges with the web portion and side flanges collectively defining a generally U-shaped channel having front and rear sides with the rear side being at a predetermined depth from the front side, a plurality of reinforcing ribs positioned in spaced-apart relationship along the length of the base and projecting transversely across the channel, at least two box-like shelf support members positioned in vertically spaced-apart relationship when the base is positioned vertically, said shelf support member comprising upper and lower spaced-apart end walls together with a front wall extending between the end walls, pivot means for pivotally connecting said lower wall of the shelf support member at a pivot location on one of said reinforcing ribs for movement in a vertical plane between a shelf-supporting position and a retracted position, said pivot location being located at the rear side of the channel whereby when the support strip is mounted on a vertical surface, a rear surface of the pivot means abuts the vertical surface, said pivot means supporting said lower end wall of the shelf support member in projecting relationship toward the front side of the channel over said one reinforcing rib for enabling the lower end wall to pivot toward said one reinforcing rib responsive to a load from the end of the shelf transmitted to the upper end wall and a support means carried on said one reinforcing rib and extending from a front surface of said pivot means toward the web portion for supporting the lower end wall and for yieldably resisting said pivotal movement of the lower end wall to protect the shelf support member from failure under load.

2. A shelf support strip as in claim 1 in which said support means comprises a yieldably web integrally joined with and extending vertically between said lower end wall and said one reinforcing rib.

3. A shelf support strip as in claim 2 in which a slot is formed between said lower end wall and said one reinforcing rib, said slot having a given depth from the pivot location of the pivot means to the lower end of said front wall of the shelf support member, and said yieldable web extends substantially 50% across the depth of the slot.

4. A shelf support strip as in claim 1 in which said one reinforcing rib has a generally horizontal upper surface, said lower end wall has a generally horizontal bottom surface, and said support means, when said lower end wall is at its shelf-supporting position, yieldably positions said lower surface at a predetermined gap distance above said upper surface when the load from the shelf is below a predetermined amount, and said support means further yielding to enable downward pivotal movement of the lower end wall while reducing said gap distance responsive to a load from the shelf above said predetermined amount for protecting the shelf support member against failure.

5. A shelf support strip as in claim 4 in which said support means enables said lower end wall to pivot downwardly responsive to a load from the shelf greater than said predetermined amount for contacting said upper surface of the reinforcing rib whereby said upper surface restrains from further downward pivotal movement of said lower end wall.

6. A self support strip as in claim 1 in which said pivot means comprises a bight portion integrally joined between said lower end wall and said one reinforcing rib.

7. A shelf support strip as in claim 1 in which said shelf support member comprises a hollow body having a pair of laterally spaced side walls which are integrally joined with said upper and lower end walls and said front wall, together with a transverse rib integrally formed with and extending across the rear side of said front wall between the side walls to resist splaying of the side walls.

8. A shelf support strip as in claim 1 for use with a fastener for mounting the shelf support strip to a support structure, the shelf support strip further including collar means forming a bore extending horizontally through the base, said bore being sized for receiving a fastener, and additionally reinforcing rib means integrally joined between the collar means and base for rigidifying the collar means while load forces are transferred from the shelf support strip to the fastener.

* * * * *